US008004409B2

(12) United States Patent
Kostrzewski et al.

(10) Patent No.: US 8,004,409 B2
(45) Date of Patent: Aug. 23, 2011

(54) WIRELESS PERSONAL INFORMATION CARRIER HAVING LOGIC FOR CONNECTING A BATTERY ONLY DURING DATA TRANSFERS

(75) Inventors: Andrew Kostrzewski, Garden Grove, CA (US); Tomasz Jannson, Torrance, CA (US); Shean T. McMahon, Seal Beach, CA (US); Sookwang Ro, Glendale, CA (US); Raghbir Tahim, Yorba Linda, CA (US)

(73) Assignee: Physical Optics Corporation, Torrance, CA (US)

( * ) Notice: Subject to any disclaimer, the term of this patent is extended or adjusted under 35 U.S.C. 154(b) by 847 days.

(21) Appl. No.: 11/706,900

(22) Filed: Feb. 13, 2007

(65) Prior Publication Data

US 2008/0191876 A1 Aug. 14, 2008

(51) Int. Cl.
*G08B 13/14* (2006.01)

(52) U.S. Cl. ..... 340/572.4; 340/10.1; 340/10.51; 711/111

(58) Field of Classification Search ..... 340/572.4, 340/572.1, 572.9, 10.1, 505, 539.1, 573.1, 340/539.11, 5.22, 5.23, 5.25, 5.65, 10.51, 340/825.71, 825.72; 711/111
See application file for complete search history.

(56) References Cited

U.S. PATENT DOCUMENTS

| | | | | |
|---|---|---|---|---|
| 6,127,917 | A * | 10/2000 | Tuttle | 340/10.1 |
| 6,290,138 | B1 | 9/2001 | Ohno et al. | |
| 6,747,561 | B1 | 6/2004 | Reeves | |
| 6,842,106 | B2 * | 1/2005 | Hughes et al. | 340/5.8 |
| 6,842,606 | B1 | 1/2005 | Takemura | |
| 6,956,833 | B1 | 10/2005 | Yukie et al. | |
| 7,106,175 | B2 | 9/2006 | Lewis | |
| 7,295,115 | B2 * | 11/2007 | Aljadeff et al. | 340/572.1 |
| 2006/0059013 | A1 * | 3/2006 | Lowe | 705/2 |
| 2007/0176748 | A1 * | 8/2007 | Salamitou | 340/10.1 |
| 2007/0200682 | A1 * | 8/2007 | Colby | 340/10.51 |

* cited by examiner

*Primary Examiner* — Toan N Pham
(74) *Attorney, Agent, or Firm* — Sheppard Mullin Richter & Hampton LLP

(57) ABSTRACT

An information carrier in a preferred embodiment is worn like a dog-tag and carries data such as medical information. The tag operates wirelessly, communicating with a nearby reader which interrogates the tag with a selected combination of RF signal frequencies. Extremely long term battery usage is achieved by connecting the battery in the tag only when the proper combination of RF signals, each at least at a minimum threshold power level, is received at the tag to produce a trigger voltage in activation logic to close a solid state switch. After a sequence of communications between the reader and the tag is then completed to transfer selected data from the memory, the battery is again disconnected to preserve battery energy for very long periods of time. The battery may be slowly recharged by ambient energy using a scavenging antenna array.

5 Claims, 9 Drawing Sheets

SCAVENGER ARRAY

MULTI-FREQUENCY COIL ANTENNA

WIRELESS PERSONAL INFORMATION CARRIER HAVING LOGIC FOR CONNECTING A BATTERY ONLY DURING DATA TRANSFERS

BACKGROUND OF THE INVENTION

1. Field of the Invention

The present invention relates generally to a wireless dog tag style apparatus for storing information for being read infrequently such as during emergencies. The invention relates more specifically to a personal information carrier device designed to be worn on a person's body and to be read wirelessly using a nearby reader for extracting selected data from the device. The device remains in an inactivated or "dead" state until it is brought to life when it is interrogated by a coded signal so that its battery retains its charge over very long periods of time.

2. Background Art

The most relevant prior art appears to be issued U.S. Pa. No. 6,747,561 to Reeves. Reeves discloses a bodily worn enclosure having memory capacity to store digitized medical records which may be retrieved using a portable wand reader unit via a so-called optical eye. The data can then be stored in the reader and sent wirelessly to a hospital base unit. One disclosed embodiment of the Reeves patent operates as a completely passive device which does not require a battery or other power source. Instead, this Reeves embodiment operates as an RFID tag to store data. Another Reeves embodiment receives operating power inductively only when being read. A transponder may be employed to emit an AM or FM signal in the event that the wearer of the device is lost and needs to be located. In this case, an on-board long life battery is included.

A disadvantage of relying on a free space optical link to download data from a bodily worn device is that the environment may not be compatible. For example, if the device is worn like a dog tag on a battlefield, there may be mud, sand or other optically obscuring materials which interfere with the optics and make the transfer of data unreliable. A disadvantage of a passive RFID tag in regard to storing data is its limited memory capacity. Large memory content is incompatible with low energy transfer, which is inherent in passive RFID tag technology. Therefore, the use of an entirely passive memory implies low content, small bandwidths and/or slow transfer rates. Inductive power transfer requires relatively large induction coils in both the bodily worn unit and the reader. Such a large coil would require a large package size making it much too large to be a dog-tag-like package.

Thus, there is still a need for a high-content wireless memory device that uses reliable radio frequency wireless data transfer technology, that operates using a battery rather than being an entirely passive device or using inductively transferred power, and which is of sufficiently small size to be worn like a dog-tag or the like. Most significantly, there is a need for such a device which can be expected to operate in an emergency on a battery that is capable of lasting over a period of years with little or no recharging.

SUMMARY OF THE INVENTION

The present invention comprises a wireless personal information carrier system, including a wireless memory tag device and a reader. The wireless memory device, such as that shown in FIG. 1 simplistically and in more detail in FIG. 9, is normally turned-off to avoid battery usage. The reader has a coded trigger to turn-on the device, to allow for memory recall, as shown in FIG. 2.

In order to obtain data from the memory tag device, the reader sends an ID-code, and only when the memory tag receives the proper ID, will it start to send the memory data. In order to receive the specific ID-information for the reader's ID-purposes, the wireless memory tag has a multi-frequency antenna in order to receive only a specific ID-signal with the appropriate combination of RF-frequencies. Otherwise, the reader will not "wake-up" the tag, and the information privacy will be preserved. The properly received ID-signal has its own sufficient power to trigger the memory tag's switch, to turn-on the tag electronic circuit. When the memory tag is turned-on, the reader sends a library-indexing signal for a specific information request. This sequence avoids delays and excessive use of the tag's battery power. Then, in response, the specific memory information is sent, wirelessly, by the tag into the reader. When information transfer is ended, the tag automatically turns-off within a few seconds, to wait for the next recall signal with power-off, and thus avoid unnecessary usage of the tag's battery power. In such a case, the memory tag can be operative for up to a 10 year period without the battery's recharge. Such operation can be effective only if the number of emergencies is low during the 10 year period, since, even in a turned-off state, there is a small leakage of battery power. The battery power will be gradually reduced by a small fraction of the original battery power each year. Now, assuming 1 min-of operation during each single emergency situation, the maximum allowable number of emergencies can be about 100. This is a reasonable number for use of this device by soldiers on the battlefield, but it can be insufficient for patients who are chronically ill. However, in the latter case, the patient usually has a specific medical pattern which will allow a reduction of each single instance of operation to only a few seconds; thus, increasing the maximum allowable number of emergencies, at least by one-order of magnitude, to about 1000. However, in usual medical applications there will be an opportunity to recharge the battery thereby avoiding any limit on the number of uses. Other applications of the memory tag device include use at any remote locations where there may be a need to wirelessly communicate status, without requiring frequent battery recharge. The invention may employ scavenging electronics including a broadband antenna array to effectively "catch" freely available RF energy at a relatively low level to slowly charge the battery and thereby compensate for gradual power leakage.

Other embodiments of the invention may be configured for being carried in clothing, being implanted under the skin, being deployed as a sensor in an array of sensors and being dropped from an aircraft onto a battlefield for example where it can be interrogated on the ground using a decoding reader. The combination of small size, large storage capacity, coded interrogation and particularly long periods between requiring battery recharge, provide many advantageous applications.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF THE PREFERRED EMBODIMENT

The basic problem addressed by the present invention, is how to preserve distributed power stored in batteries located remotely and difficult to recharge. It is easy to distribute memory data, but it is difficult to distribute power, especially when data content is high, up to 4 GB, or even higher. The solution, which is the subject of this invention, is a "rechargeable trigger" (i.e., a trigger signal that can send electromagnetic energy, sufficient to "activate" the memory tag, herein called Distributed Wireless Memory Tag (DWMT)). The trigger is a Tx/Rx (transceiver) subsystem, located in part at the reader, and located in part at the tag. The trigger is similar to one that is used in RFID-devices, except the trigger DWMT memory content is much larger than that in the RFID case (e.g., 4 GB vs. 128 bytes). Another difference is that the RFID tag is much slower than the DWMT. Memory transfer in the preferred embodiment of the invention can be very fast (up to 100 Mbit/sec). The RF range between the reader and the DWMT is about 30 feet, to satisfy a privacy requirement. The range can also be increased variably, up to about a 100 ft. range, in a programmable fashion. The actual range of operation in any embodiment will depend on RF power level, antenna gain in the reader and tag device and the RF frequency of transmission.

The basic difference between prior art wireless memory devices and the present invention is that prior art devices work in a "sleepy mode" where some power is constantly used, while the invention works in a "turn-off mode" where power is not used at all, except for unavoidable small environmental leak levels that can be reduced to cause only about a 40% power loss per 10 years, but typically causes a 5% power loss per year. Therefore, the principal novel features of the invention are: low power usage, variable range, security, high memory content and high transmission speed.

Figure 1:
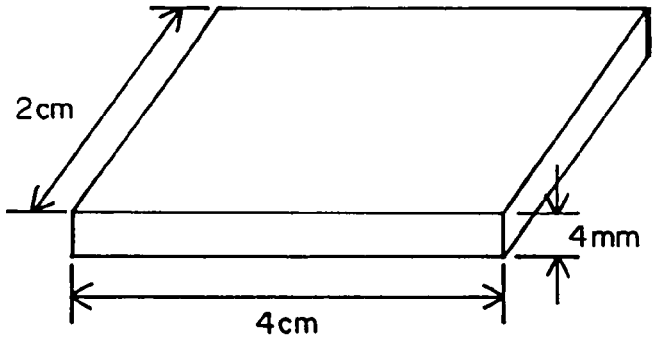
FIG. 1 is a conceptual outline of a wireless memory tag device according to a preferred embodiment showing its approximate dimensions.
Figure 2:
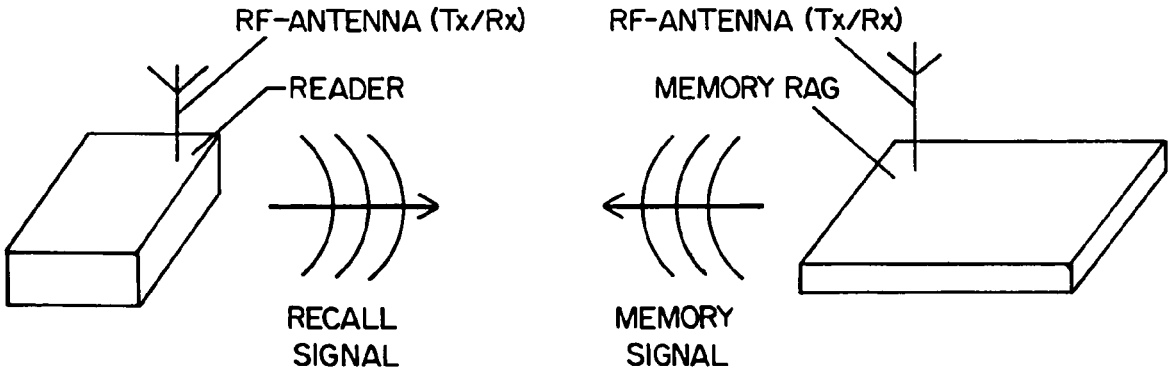
FIG. 2 is a conceptual diagram of a memory tag/reader of the invention.
Figure 3:
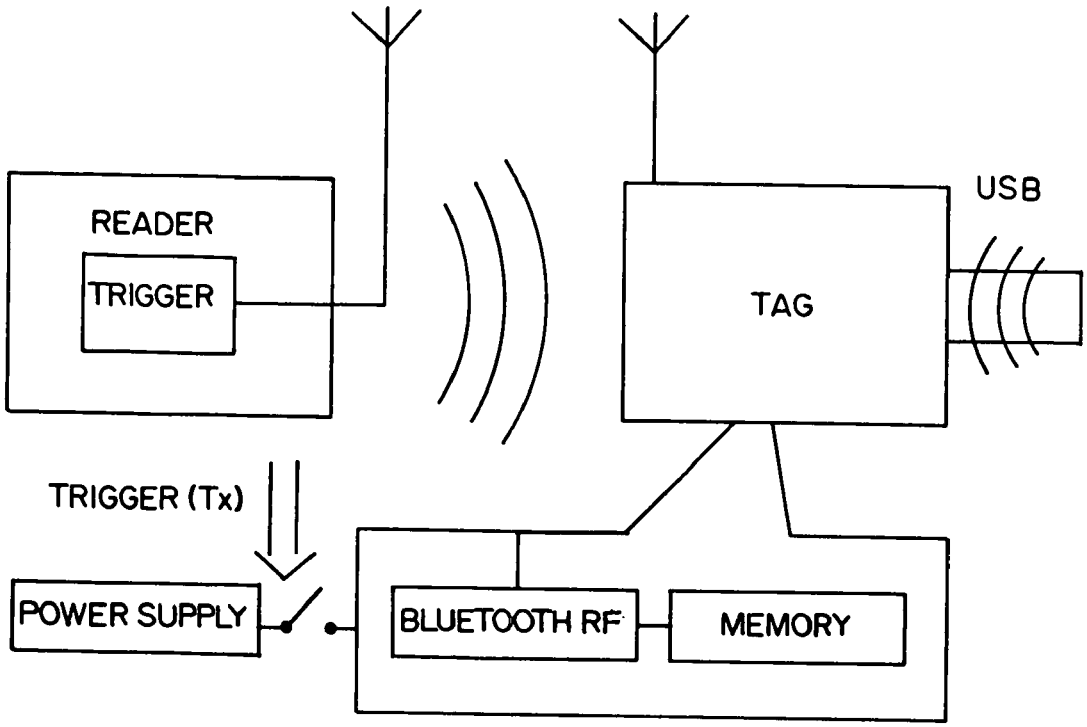
FIG. 3 is a general block diagram of a memory tag and reader of the invention showing essential components for the operation thereof.

The memory tag receiver has a resonance circuit for a specific few (2-3) frequencies, to avoid accidental triggering and afford privacy protection. In FIG. 3, the memory tag system, consisting of the reader and the tag, is shown, and in FIG. 4, a more detailed block diagram illustration of the memory tag is shown. The two sub-systems (reader and tag) have antennas for Tx/Rx-RF-communication. The reader has a Tx-trigger and a receiving circuit (not shown) for memory data. The memory tag (called DWMT herein) consists of a RF radio physical layer and link layer, such as Bluetooth, 802.11x, Zigbee as well as memory and power supply (battery). The digital connector such as USB or firewire is for memory data transfer and battery charging.

Figure 4:
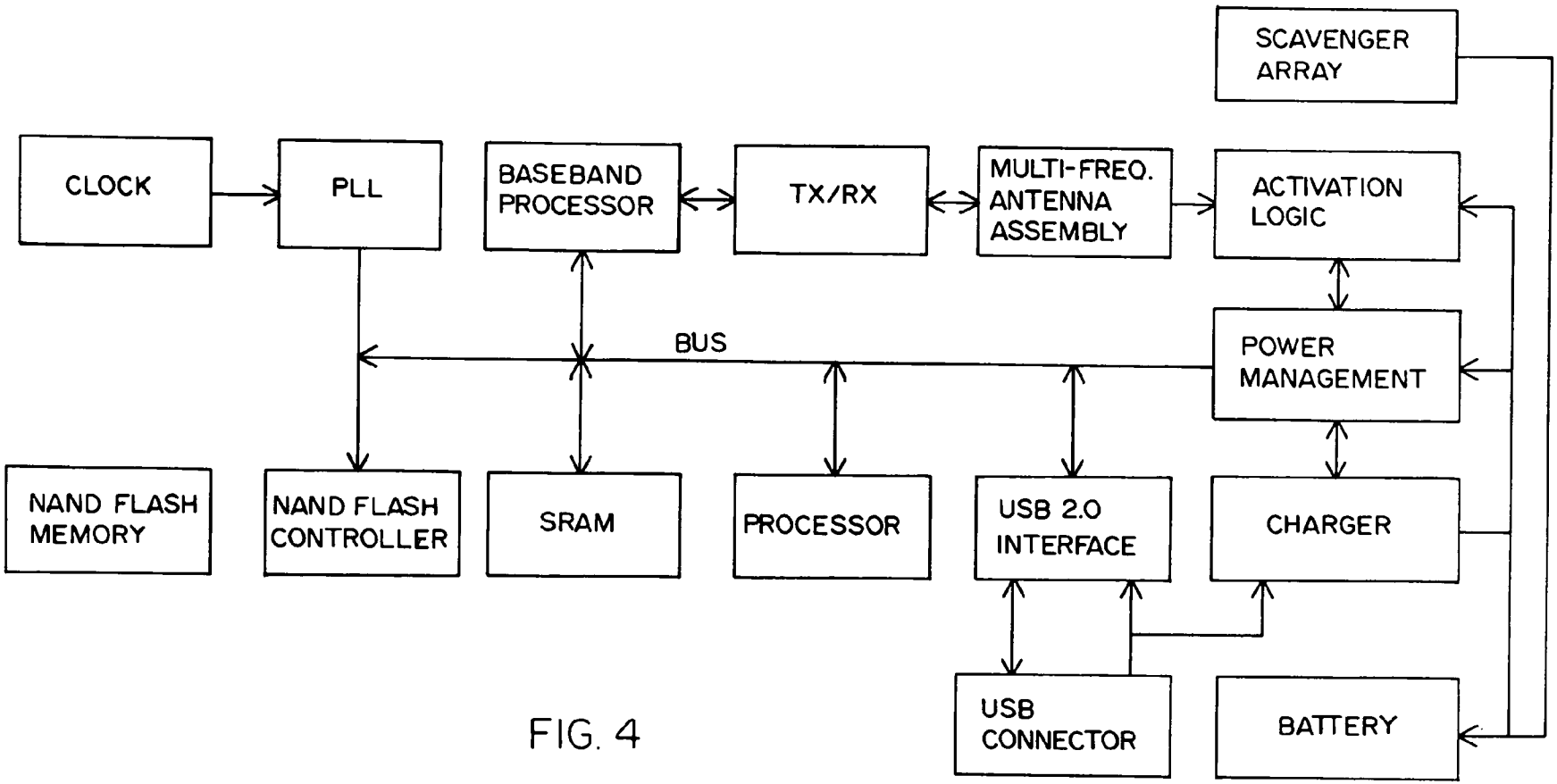
FIG. 4 is a more detailed block diagram of the memory tag portion of the invention.

Referring to FIG. 4, in which the tag device embodiment is shown in block diagram form, it will be seen that the device comprises a NAND flash memory that has a memory capacity of at least 4 GB and interfaces with an internal bus through a NAND flash controller. Also included is a processor, an SRAM and a clock operating with a phase lock loop. These basic circuit components operate to write and read data in the NAND flash memory. Such data is communicated wirelessly by means of a base-band processor, transceiver (Tx/Rx) and a multi-frequency antenna assembly. A USB 2.0 interface and USB connector are employed to initially upload data into the NAND flash memory.

The tag device shown in FIG. 4 is powered by a battery when in its fully operational mode.

Figure 5:
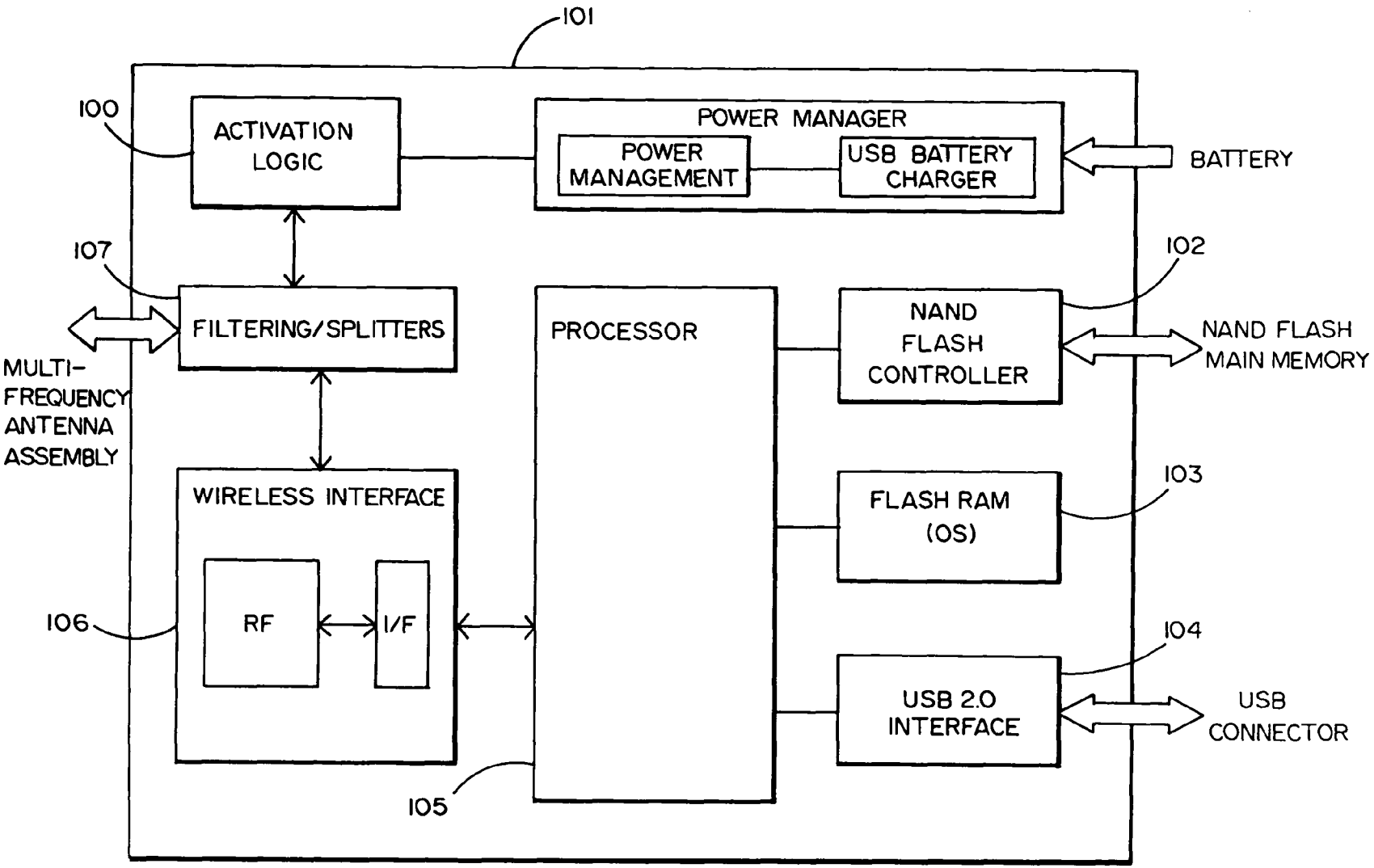
FIG. 5 is a view of a System-on-Chip (SoC) which may be employed in the preferred embodiment of the memory tag.

FIG. 5 illustrates those components of the tag device which are preferably provided as a System-on-Chip (SoC) configuration. Each component thereof is identified and described as follows:

100—Activation Logic or (Trigger Circuit)—Activates the memory tag device when a valid trigger signal is detected. Typically the device will be in the power-off state. When a trigger signal is detected (STEP A), the activation logic signals the power management block (101) (STEP B). The power management block (101) powers up the other device components (STEP C).

101—Power Management—Provides the device's power management. On/off state and sleep/stand-by modes are managed by this block, as is monitoring of battery status. This block also contains a USB battery charger circuit that charges the device's internal battery.

102—Flash Memory Controller—Manages the device's memory. The device utilizes non-volatile flash-based memory for data archiving. Any read or write operation to this memory is routed through the memory controller block (102). The memory controller block performs the various data conversion operations between the flash memory and the bus, and controls housekeeping functions such as erase operations.

103—Flash RAM—Contains the device's operating system (OS) (real-time operating system (RTOS), Microsoft Windows CE, custom designed codes, etc). The OS is embedded software that controls all device operations. When data is requested (STEP A), the OS issues a request to the memory controller (103) for the data (STEP B). The OS then manages the routing of that data to the appropriate communication port (USB port (104), or wireless interface (106)) (STEP C). Data writes occur in a reverse order. The OS is also responsible for disabling writes if battery power is below a preset threshold, ascertaining the correct port to utilize for data access, and disabling the wireless port when a physical connection is in effect. This is necessary to prevent data synchronization errors.

104—USB Port Controller—Implements physical layer connectivity (power and data) between the device and a host computer using the USB 2.0 standard protocol. The USB controller (104) manages all details of the USB connection. These include establishing the connection, handshaking, data conversions, error detection and correction, and translation of the data between the device's internal format and the USB packets.

105—Microcontroller—Manages the entire memory tag device. The microcontroller (105) provides a platform for the OS to run on, and provides the necessary hardware to support for all internal operations.

106—Wireless Interface—Implements wireless connectivity on the device. The wireless interface performs a role similar to the USB port controller (104). When data is to be transmitted over the wireless link, raw data from the microcontroller (105) is passed to the wireless interface (106) (STEP A). The interface converts the data to a bit stream and modulates the stream on an RF carrier wave (STEP B). The signal is then passed through the filtering/splitters block (107), and sent to the Tx/Rx patch antennas (STEP C). Receiving data is performed in the reverse order.

Figure 8:
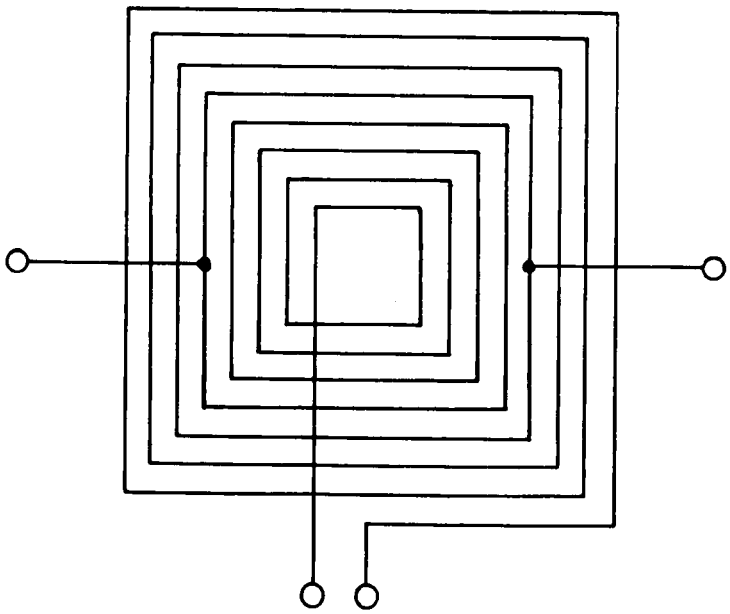
FIG. 8 is a conceptual view of a multi-frequency coil patch antenna.

107—Filtering/Splitters—Splits data between the trigger (100) and wireless interface (106) blocks. A signal incident on the Rx/Tx antennas will be either a trigger signal, or a communication signal. Filtering is employed to isolate the trigger signals from the wireless interface signals. This is necessary as the wireless interface (106) and the trigger block (100) share patch antennas as shown in FIG. 8.

A trigger signal is transmitted to the tag device and received by the patch antennas (STEP A). The signal is routed to the filtering/splitters block (107), where it is directed to the trigger block (100) (STEP B). The trigger block (100) analyzes the received signal, and if the signal is valid, it signals the power management block (101) to turn on the device (STEP C). The power management block (101) turns on the microcontroller (105), which in turn powers up the other blocks (102-104, 106) (STEP D). The tag device then waits for a communication signal (STEP E). When a signal is received at the filtering/splitters block (107), it is passed to the wireless interface block (106) where it is then decoded, and routed to the microcontroller (105) (STEP F). The microcontroller (105) then performs the requested action (STEP G)

A charger is provided to permit "topping off" the battery via the USB connector. However, as described herein, during deployment of the tag device in its normal modes of use, the battery is effectively deactivated or disconnected from the remaining circuits between memory access events to provide a long-term capability. This function is provided by activation logic and power management circuits. The activation logic is shown schematically in FIG. 6 which will be described herein below. The power management circuit is substantially a solid state switch controlled by the output of the activation logic to connect the battery whenever a pre-selected combination of RF frequencies, at a sufficient signal level, is received through the multi-frequency antenna assembly.

The tag device can operate at 10 m, or larger distances between the reader and the tag. This is due to the novel concept of the trigger which is the core of the present invention. The prior art trigger devices, such as those used for RFID, can operate only at short (<1 ft.) distances. They have a single fixed frequency, typically 13.5 MHz. In contrast, the present device operates with two or more lower frequencies for security purposes. Low frequencies, deliver more power to the device. This is because the free-space RF loss is proportional to $r^2$ where r-distance, and $f^2$ where f is antenna RF frequency. Thus, to preserve RF power, we have to keep the constant product:

$$r \cdot f = \text{constant}$$

In order to increase distance, say, two times, we also need to reduce the frequency two times. For example, if we would like to increase the operational distance from 1 ft. to 10 m; i.e., about 30 times, we should reduce frequency 30 times. Therefore, where the preferred embodiment uses at least two frequencies for ID purposes, we need to reduce these frequencies below 10 MHz. This, in turn, dictates the complexity of trigger input antenna architecture, by introducing coil-type antenna architecture. Thus, we will deliver more power to the activation logic. The tag trigger logic can have selected programmable parallel frequencies.

Figure 6:
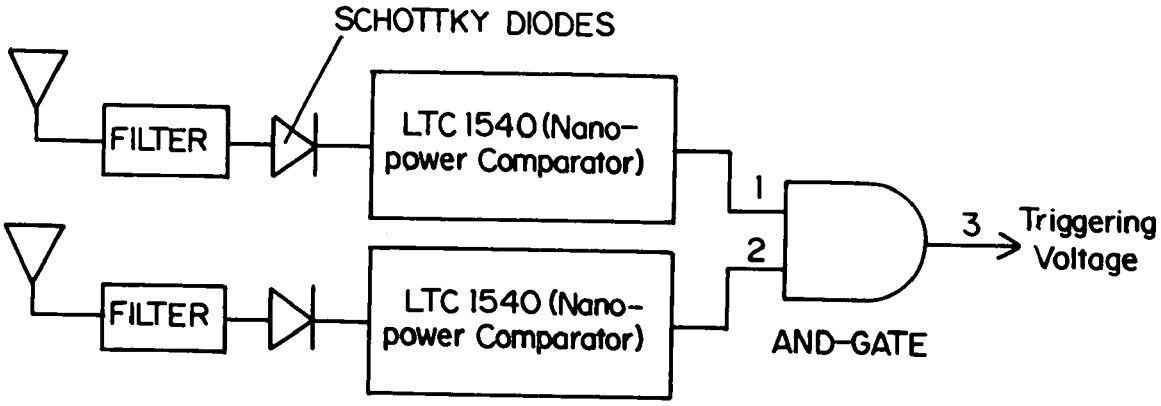
FIG. 6 is a schematic drawing of a logic circuit used in the tag.

These parallel frequencies, are recognized by logic of the trigger output, illustrated in FIG. 6. The end logic is such that the trigger output responds, only when all code components are present. Otherwise, the system does not respond. In the military application (soldiers in the field), a single signal is sufficient, since the soldiers are dispersed, so the trigger only activates the tag of the soldier that needs medical help, for example. The trigger does not activate the tags of other soldiers if they are at distances larger than threshold value (e.g., 10 m). In other applications, more codes (i.e., up to a thousand or more) may be needed. The AND-Gate (representing end logic), the nano-power comparators filters, and Schottky diodes (rectifiers), together with receiver antenna, are components of the trigger output, shown in FIG. 6.

The remote triggering of transceiver devices is based on two subsystems: transmitter and the receiver. The receiver part (or trigger output) is integrated with the tag, while the transmitter (or trigger input) is the outside triggering device, which generates and transmits two (or more) RF signals for example at 2.1 MHz and 5.2 MHz simultaneously. These RF signals are transmitted using a single dual band chip omnidirectional antenna or two chip antennas, one operating at 2.1 MHz and the other at 5.2 MHz. A multifrequency antenna for use at those two frequencies is shown as a tapped, coil patch antenna in FIG. 8.

The receiver part also consists of a multi-band antenna, the outputs of which are detected by a Schottky diode (or rectifier) connected at the outputs of the antenna. The detected DC voltages from the antenna form the inputs to two voltage comparators (Op-amps) circuits as shown in FIG. 6. The voltage comparator (LTC1540) device requires 1.4 μ-amp at $V_{BAT}$=2 Volt.

In this activation scheme, the two received RF signals are converted into DC voltages (using Schottky diode) as shown in FIG. 6, which then power up an internal electronic control circuit which requires two DC voltages of about 10 milli-volt (at the input) to generate the control voltage. The control voltage at Pin 3 is only generated when two voltages are input at pins 1 and 2 of AND-Gate control device. These two DC voltages will appear at the control device when two RF signals are transmitted, simultaneously. The advantage of this scheme is that it requires extremely low power consumption (1.4 μ-amp) and the system will only operate when the RF signals of the correct frequencies are present.

Figure 6A:
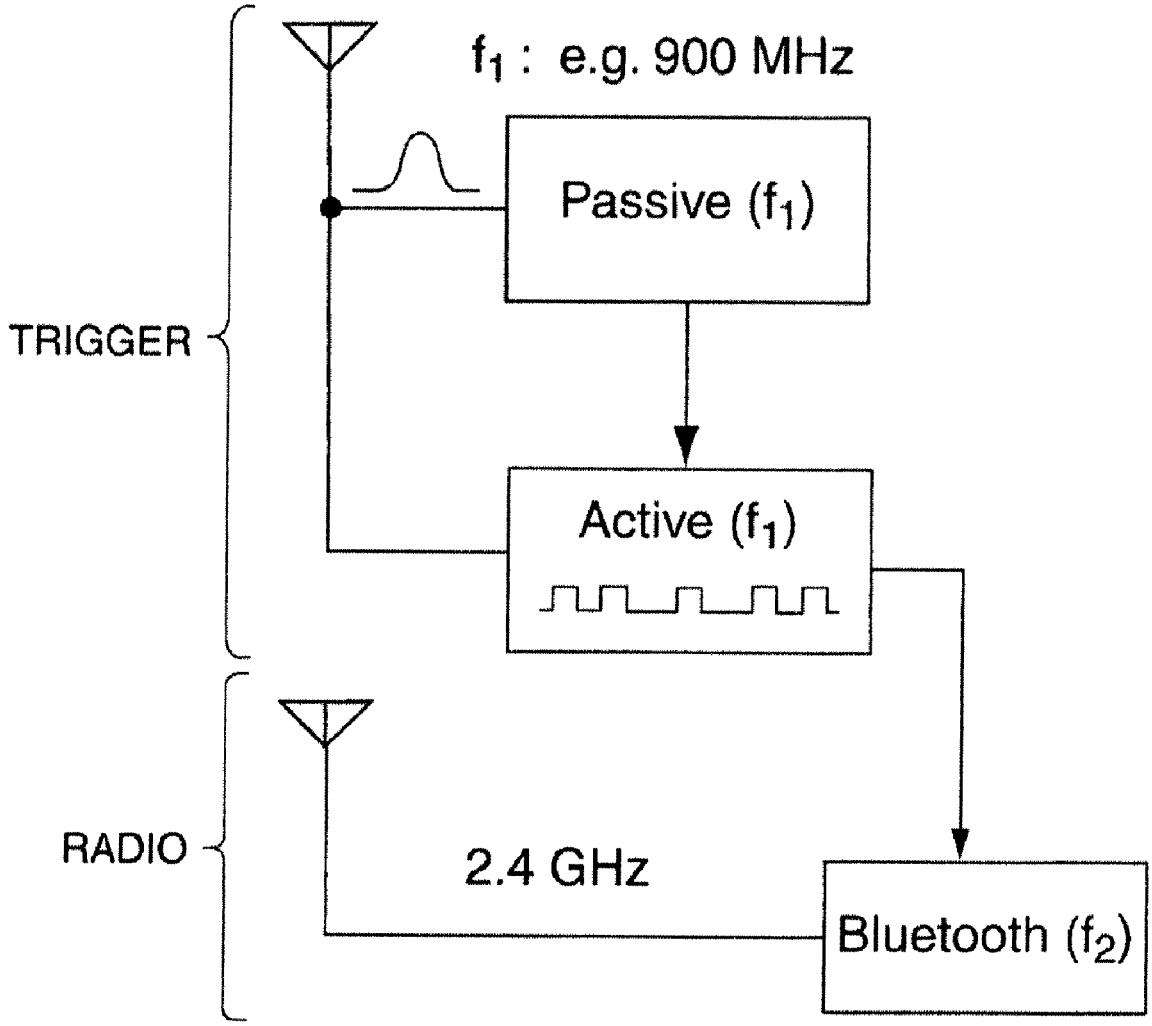
FIG. 6*a* illustrates an alternative triggering embodiment.

An alternative triggering scheme is depicted in FIG. 6A. In this embodiment a trigger RF signal at say 900 MHz is received. This received RF signal enables a "passive" logic block, which in turn enables a subsequent "active" block that may or may not operate at 900 MHz. The "active" block receives a coded bit stream modulation signal. If the proper selected code is present, a main tag radio is activated. A Bluetooth radio operating at 2.4 GHz being an example. This scheme provides a greater level of security and affords a significantly greater number of possible codes for very large populations of information carriers. However, this scheme may be susceptible to a "thrashing" effect which can drain the battery more quickly.

Figure 9:
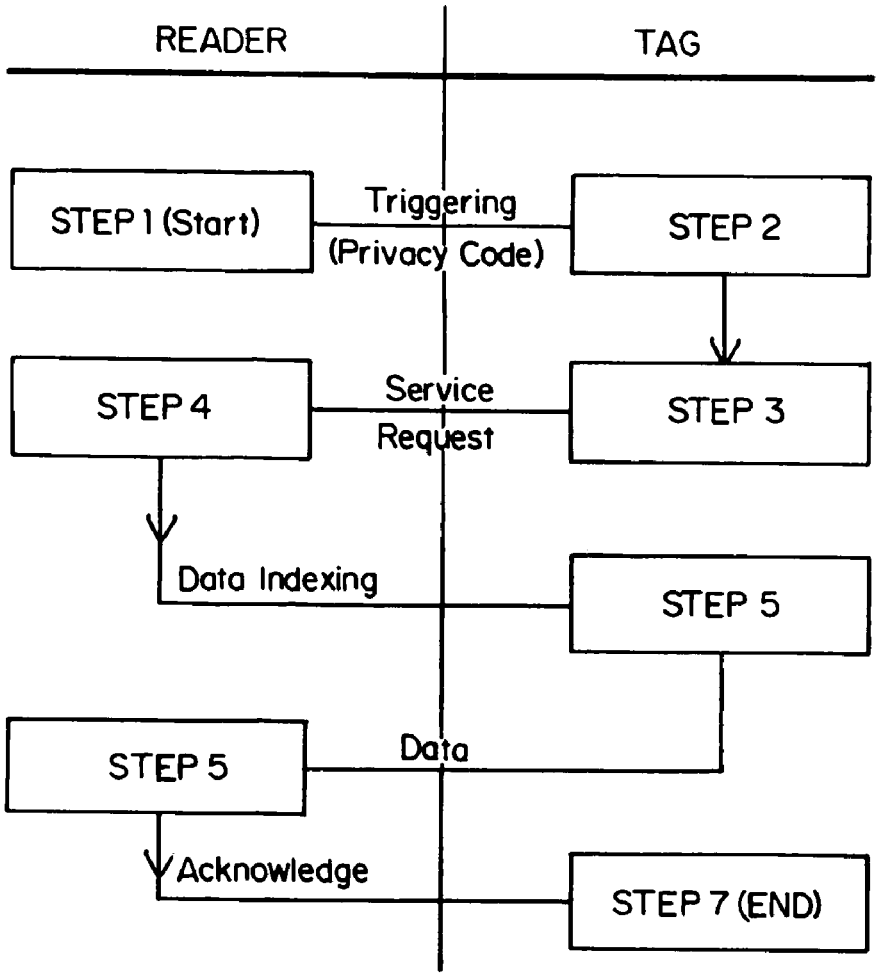
FIG. 9 is a step-by-step sequence drawing of the communication process between the memory tag and the reader in a preferred embodiment.

The basic concept of operation is as follows. First, the reader trigger sends a 2-3 frequency code to the tag (STEP1). Upon decoding the frequencies, power is activated in the main tag system, which is now in operation (STEP2). Then, the tag sends a return signal with the request to service the tag (STEP3). In response, the reader sends indexing data requesting specific information stored in the tag memory (STEP4). In response, the tag sends the requested data (STEP5). Upon receiving the requested data, the reader sends the ending acknowledge signal (STEP6). Upon receiving the ending acknowledge signal, the tag ends the operation by again powering down and entering its "turn off" mode (STEP7). The sequence of operation is illustrated in FIG. 9.

Figure 10:
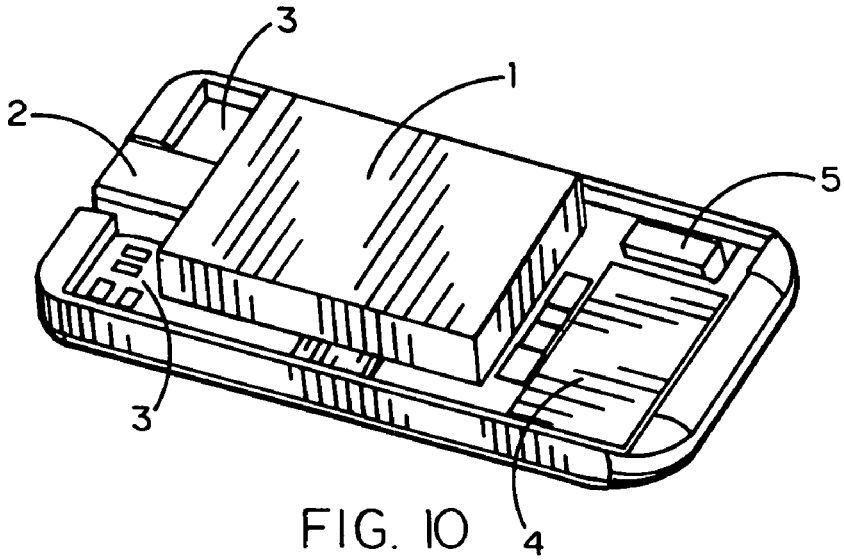
FIG. 10 is a three-dimensional view of a memory tag device without a cover.
Figure 11:
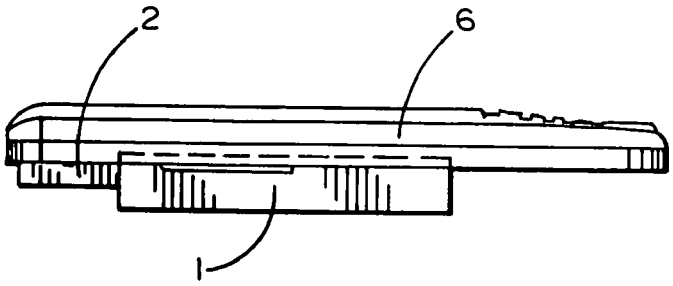
FIG. 11 is a vertical cross-sectional view thereof.
Figure 12A:
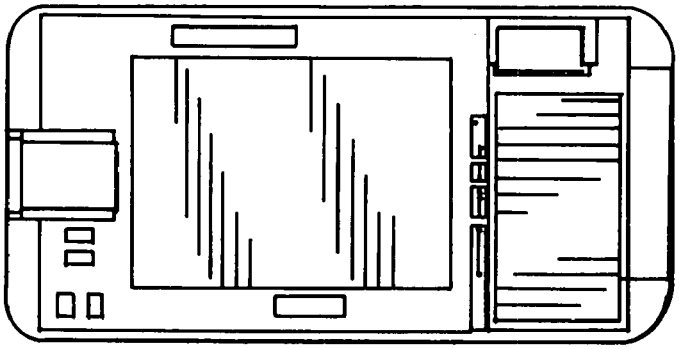
FIG. 12 is a top view (12A) and side view (12B) thereof.
Figure 12B:
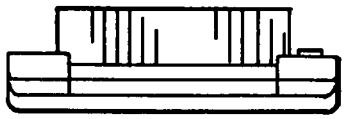

In FIGS. 10 to 12, the DWMT-tag device is shown, including: a general 3D view (FIG. 10), its vertical cross-section (FIG. 11), and its top view (FIG. 12). Device components in FIG. 10 are: battery 1; USB connector 2; wireless memory controller and Bluetooth RF-module (physical layer and link layer) 3; Bluetooth and RF trigger 4; and RF antenna 5; as well as PCB 6 in FIG. 11. FIG. 12A shows the device's top view, and FIG. 12B, its side view. A bracelet or necklace chain hook 8 allows the tag device to be worn.

Figure 13:
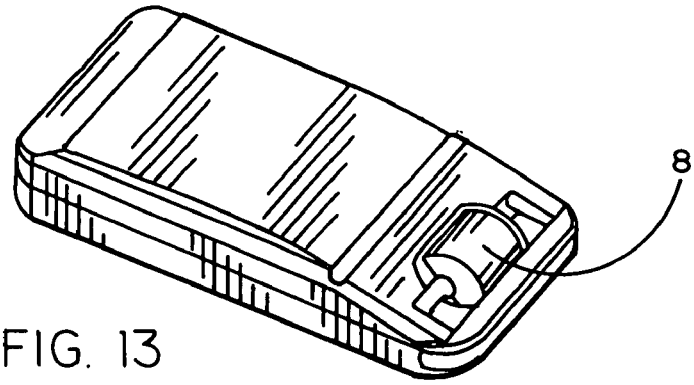
FIG. 13 is a three-dimensional view of the covered top device.
Figure 14:
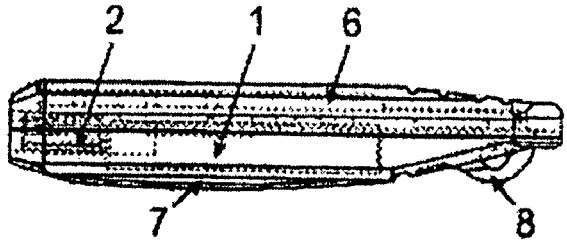
FIG. 14 is a vertical cross-sectional view thereof.
Figure 15A:
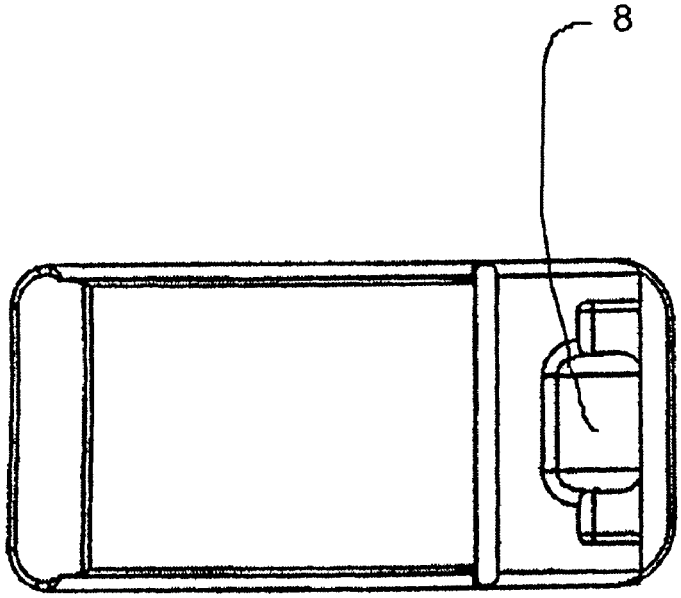
FIG. 15 is a top view (15A) and a side view (15B) thereof.
Figure 15B:
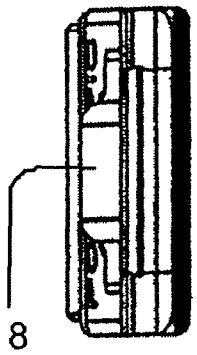

In FIGS. 13 to 15, the DWMT-tag device, with cover housing 7, is shown, with FIG. 13, being equivalent of FIG. 10; FIG. 14, being equivalent of FIG. 11 and FIG. 15 being equivalent of FIG. 12.

The inventive system also has the ability for electromagnetic energy collecting ("scavenging"), using the RF energy available in the environment (there are, almost always, some RF electromagnetic waves propagating through space, including at least 10 RF-signal providers). Such energy can be stored within the tag power module for later usage. The energy efficiency of such a process is rather low (5-10%), but it is sufficient to "feed" the tag, over a virtually indefinite period of time.

There are many forms of energy: electromagnetic, electrical, mechanical, chemical, thermal, and others. Some of those energies come from directed movements of macroscopic bodies (mechanical movement) and particles (electrical current), etc., some other from random movement (heat). Those energies coming from directed movements are higher quality than those coming from the random movement. Higher quality means lower entropy, or higher negantropy (negative entropy). If transformation of one energy to another is from high-quality energy to another high-quality energy, then it is easier to store, or to use such energy in the form of some work. An example is transfer of light (photon) energy into mechanical energy in the form of so-called solar wind. Assuming the directed photon energy (which is a form of electromagnetic energy) as a light beam, such a beam has linear momentum, which can be transferred into mechanical momentum, as in a commercial device in the form of vacuum ball with membrane fin rotator that can rotate due to a flash lamp, with the light beam directed into the mirror side of a fin.

A similar situation occurs when storing electromagnetic energy, such as when using an electrical storage device, consisting of an inductor and a capacitor with semiconductor diode transforming alternating current (AC) into direct current (DC). In the context of the above comments about high-quality directed energy, it would be appropriate to consider the analog between an electromagnetic wave as an electromagnetic oscillator that can transfer its energy into a mechanical oscillator. Here, the transfer of the AC into DC has limited conversion efficiency (about 10% or less). Within this power budget, we can transfer available RF energy which almost always exists in any area crowded with cellular phone RF signals. Typically, in any urban space, we have on the order of at least ten cellular providers that send RF signals crossing almost any area. If the tag of the present invention is located in such an area, it can scavenge this RF energy for storage purposes. Since such a tag energy storage device can be constantly receptive to energy, such scavenged energy can be added into the tag's battery as a supportive energy source, or can even replace the battery if we employ some other form of energy storage.

Figure 7:
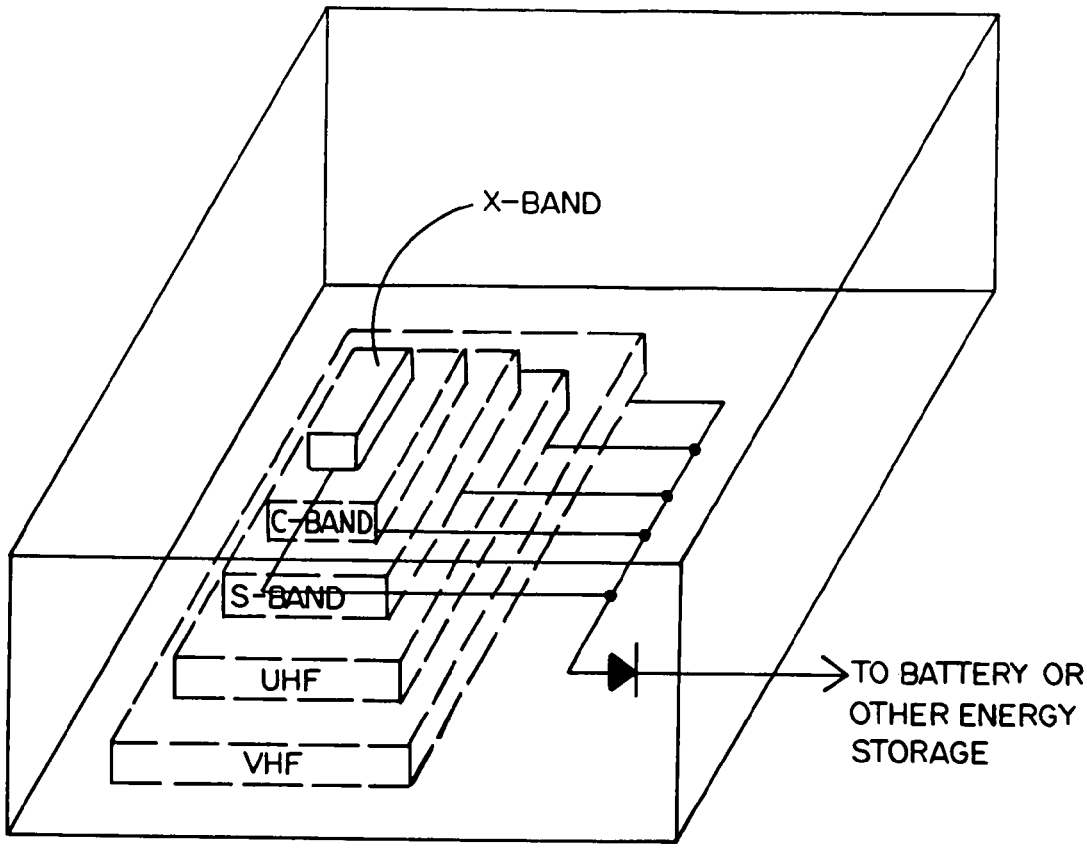
FIG. 7 is a conceptual view of a broadband scavenger antenna array stack.

A broadband stacked antenna array for use as a scavenger RF input is shown in FIG. 7. Each antenna in the stack is connected to a common diode which feeds the battery through a suitable interface storage device such as a capacitor which is connected for delivering a charging voltage to the battery.

Having thus disclosed at least one illustrative embodiment, it will now be apparent to those having skill in the relevant arts that various modifications may be made to the invention without deviating from the inventive features thereof. Thus, the scope hereof is limited only by the appended claims.

We claim:

1. A method for a wireless information storage to be interrogated by a proximate reader; the method comprising the steps of:

receiving a trigger signal at a first frequency using a first radio circuit;

activating a decoding circuit of the first radio circuit in response to receiving the trigger signal;

receiving a coded signal at the first frequency using the first radio circuit;

decoding and validating the coded signal using the first radio circuit; and if the coded signal is validated, activating a second radio circuit by closing a solid state switch interposed between the battery and the second radio circuits; and performing a wireless information transfer at a second frequency from the storage device to the reader using the second radio circuit.

2. The method of claim 1, wherein the coded signal is a bit code modulated RF signal.

3. The method of claim 1, wherein:

the step of activating the decoding circuit is performed passively using energy from the trigger signal; and the step of decoding and validating the coded signal is performed actively using energy from the battery.

4. The method of claim 1, wherein:

the step of receiving the trigger signal is performed using a first antenna; and the step of performing the information wireless transfer is performed using a second antenna.

5. The method of claim 1, further comprising:

receiving an index signal at the second frequency from the reader; and receiving an acknowledgement signal from the reader;

wherein the information wireless transfer comprises transmitting data corresponding to the index signal to the reader.

* * * * *